US010455947B2

(12) United States Patent
Störiko

(10) Patent No.: US 10,455,947 B2
(45) Date of Patent: Oct. 29, 2019

(54) CHAIR

(71) Applicant: Störiko Product Design GmbH, Hamburg (DE)

(72) Inventor: Andreas Störiko, Köln (DE)

(73) Assignee: STÖRIKO PRODUCT DESIGN GMBH (DE)

( * ) Notice: Subject to any disclaimer, the term of this patent is extended or adjusted under 35 U.S.C. 154(b) by 0 days.

(21) Appl. No.: 15/747,595

(22) PCT Filed: Jul. 6, 2016

(86) PCT No.: PCT/EP2016/066011

§ 371 (c)(1),
(2) Date: Jan. 25, 2018

(87) PCT Pub. No.: WO2017/021089

PCT Pub. Date: Feb. 9, 2017

(65) Prior Publication Data

US 2018/0213941 A1 Aug. 2, 2018

(30) Foreign Application Priority Data

Jul. 31, 2015 (DE) ..... 10 2015 112 618

(51) Int. Cl.
*A47C 7/58* (2006.01)
*A47C 7/56* (2006.01)
(Continued)

(52) U.S. Cl.
CPC ..... *A47C 7/563* (2013.01); *A47C 3/185* (2013.01); *A47C 7/58* (2013.01); *A47C 7/60* (2013.01); *A61G 5/14* (2013.01)

(58) Field of Classification Search
CPC ..... A47C 7/563; A47C 7/004; A47C 7/58; A47C 7/60; A47C 3/04; A47C 3/045; A47C 3/185; A61G 5/14
(Continued)

(56) References Cited

U.S. PATENT DOCUMENTS 2,146,932 A 2/1939 Boman
3,982,785 A * 9/1976 Ambasz ..... A47C 1/023 297/160
(Continued)

FOREIGN PATENT DOCUMENTS

DE 651193 C 10/1937
DE 1833341 U 6/1961
(Continued)

OTHER PUBLICATIONS

German Office Action dated Jul. 13, 2017 in corresponding German application No. 10 2015 112 618.4, 8 pages.

*Primary Examiner* — Mark R Wendell
(74) *Attorney, Agent, or Firm* — Lucian Wayne Beavers; Patterson Intellectual Property Law, PC

(57) ABSTRACT

A chair has a base and a support articulated thereon. The support is coupled to a seat and supports the seat. The seat is connected to the support rotatably or pivotably around a rotation axis between a sitting position and a raised position, and the support has at least one receiving region for aligned abutment of a juxtaposed chair of identical design. Provision is made in this context that in the raised position, the seat is pivoted out of the receiving region of the support and exposes the receiving region. The result is to create a chair that, for storage, can be juxtaposed in space-saving fashion with chairs of identical design.

15 Claims, 6 Drawing Sheets

(51) Int. Cl.
*A47C 3/18* (2006.01)
*A47C 7/60* (2006.01)
*A61G 5/14* (2006.01)

(58) Field of Classification Search
USPC ..... 297/302.2, 302.1
See application file for complete search history.

(56) References Cited

U.S. PATENT DOCUMENTS 6,481,789 B1 11/2002 Ambasz
6,755,468 B1 * 6/2004 Pan ..... A47C 3/045 297/239
7,296,853 B2 * 11/2007 Piretti ..... A47C 3/04 297/239
7,806,478 B1 * 10/2010 Cvek ..... A47C 1/03255 297/300.1
8,083,288 B1 * 12/2011 Warncke ..... A47C 3/20 297/134
8,967,714 B2 3/2015 Machael
2003/0218370 A1 * 11/2003 Langham ..... A47C 3/18 297/344.22
2007/0120406 A1 * 5/2007 Piretti ..... A47C 3/04 297/331
2011/0175412 A1 * 7/2011 Piretti ..... A47C 3/045 297/239
2012/0313411 A1 * 12/2012 Fletcher ..... A47C 3/04 297/239
2015/0164225 A1 * 6/2015 Bohmann ..... A47C 1/03255 297/313
2015/0257537 A1 * 9/2015 Besler ..... A47C 3/185 297/316

FOREIGN PATENT DOCUMENTS

DE 4426922 A1 2/1996
DE 10215649 A1 10/2003
DE 60013359 D1 10/2004
JP 06225820 A 8/1994
NL 1026111 C 11/2005
WO 2010088671 A1 8/2010

* cited by examiner

CHAIR

The invention relates to a chair having a base and a support, articulated thereon, that is coupled to a seating surface and supports the latter, the seating surface being connected to the support rotatably or pivotably around a rotation axis between a sitting position and a raised position, and the support comprising at least one receiving region for aligned abutment of a juxtaposed chair of identical design.

Office chairs whose seat, comprising a seating surface and a seat back, is mounted on a base rotatably around a vertically arranged axis, are known. The base can be embodied as a star base. A star base of this kind is usually embodied from four or five spokes on which pivotably mounted casters are fastened. A disadvantage of such chairs is the large amount of space required for storing them, since they cannot be stacked inside one another.

DE 102 15 649 A1 discloses an office chair having a synchronized rocker mechanism. The rocker mechanism enables a displacement of the seating surface simultaneously with a displacement of the seat back of the chair. The chair is constructed from a tubular frame, a cover being stretched between the tubes and respectively constituting the seating surface and the seat back. According to an embodiment, the seating surface is rotatable in its rear region and is mounted linearly movably in an obliquely upward direction. At the same time, the seating surface is mounted rotatably in its front region. A second office chair of identical design can thus be pushed from behind into the first office chair, in which context the seating surface of the second chair slides under the seating surface of the first chair and pushes it upward along its linear guide. The seating surface thus forms receiving regions against which a second chair can be juxtaposed. The spokes of a base, configured as a star base, of the chair are, when directed rearward, fastened higher up on a hub than the spokes directed forward, so that the front spokes of the rear chair can be pushed beneath the rear spokes of the front chair. Any number of office chairs can thus be juxtaposed. Disadvantageously, the seating surface of the office chair must be embodied to be narrower than the seat back, so that the tubular structure of the seat can be inserted between that of the seat back. This is detrimental to seating comfort. It is also disadvantageous that receiving regions against which a second chair can be juxtaposed are embodied on the seating surface. This results in elevated wear on the seating surfaces when they rub against one another upon insertion of a chair. In particular, the entire weight of the front chairs of a row of chairs rests on the rear seats, resulting here in an increased load with increased wear. It thereby furthermore becomes difficult to juxtapose chairs against the row of chairs from behind, since then the seat of the rearmost chair of the row must be lifted against the great weight of the front chairs braced thereon. It is also possible for the rear chair to be pushed rearward out of the assemblage as a result of the obliquely acting force transferred from the front seats. The outer chairs of a row of chairs must therefore be prevented from rolling away.

WO 2010/088671 A1 discloses stackable chairs slidable into one another. Two first frame parts, arranged spaced apart from one another, form rear chair legs, mounted on casters, which transition upward into armrests. Provided between them, also spaced apart, are two further frame parts, arranged crosswise to the first frame parts, which form the front chair legs equipped with casters and carry the seat back in the upper region. The seating surface of the chair is mounted rotatably in the oppositely located crossing points of the first and second frame parts, and can be pivoted between a sitting position and a raised position. In the raised position, chairs of identical design can be juxtaposed against one another, the seat back of the front chair resting against the subframe of the seating surface of the rear chair. Alternatively, the chairs, with seating surfaces swung up, can be stacked above one another, the casters of the respective upper chair being guided along the frame parts of the lower chair and being supported thereon. The design of the chair does not enable the use of a base, so that chairs having rotatably mounted seats cannot thereby be implemented.

The object of the invention is therefore to create a chair that has a seat and can be juxtaposed in space-saving fashion against further chairs of identical design without damaging the chair.

The object of the invention is achieved in that in the raised position, the seating surface is pivoted out of the receiving region of the support and exposes it. In the sitting position, the seating surfaces that are located on one plane prevent the chairs from being juxtaposed closely against one another. In the raised position the seating surface exposes the receiving region, which is advantageously arranged on the support of the chair. That surface is moved by the pivoting motion sufficiently far away from the receiving region that a portion, provided for abutment, of a chair that is to be juxtaposed can be slid through past the seating surface, for example under the raised seating surface, against the receiving region. As a result, chairs can be slid into one another and juxtaposed in space-saving fashion without causing the seating surfaces to bump into one another and thereby become worn.

Advantageously, provision can be made that the support comprises an inner receiving region open outward; and/or that the support comprises an outer receiving region; and that in the raised position, the seating surface exposes the inner receiving region and/or the outer receiving region. For juxtaposition of chairs against one another, the inner and the outer receiving region can be embodied in such a way that the outer receiving region of the one chair engages into the inner receiving region of a juxtaposed chair. The chairs thus abut against one another with their supports, which have previously been exposed by the raising of the seating surfaces. Advantageously, defined contact surfaces, made e.g. of plastic, can be attached to the inner and/or outer receiving region of the support of the chair. These contact surfaces can then form the stop between juxtaposed chairs. The seating surfaces and seat backs of juxtaposed chairs, and their covers, thus do not come into mutual contact. It is also possible to produce the supports partly or entirely from plastic, with the result that wear can be minimized. An essential idea of the invention is that juxtaposed chairs touch only at the supports. Contact thus occurs only in an non-visible region of the chairs. Visible regions do not touch one another and are thus not subject to increased wear. Thanks to a suitable conformation of the inner and outer receiving regions, mutual alignment of the chairs can be effected by contact between the supports.

Suitable receiving regions can be obtained by the fact that the support comprises two limbs; that the limbs are connected at one end; and that those regions of the limbs which face toward one another form at least a portion of the inner receiving region, and those regions of the limbs which face away from one another form at least a portion of the outer receiving region. A support constructed in this manner can be manufactured inexpensively. It makes possible on the one hand secure placement and retention of the seating surface in its sitting position, and on the other hand the formation of suitable receiving regions for juxtaposition thereon of chairs of identical design.

If provision is made that the limbs are arranged with respect to one another at least locally in a U-shape or V-shape, the chairs become aligned and centered upon juxtaposition. The limbs can be embodied in straight-line fashion, but also can be curved.

Provision can preferably be made that the seating surface and a seat back of the chair are connected integrally to one another; and/or that the seating surface and the seat back are embodied separately and that the seat back is fastened indirectly or directly to the support. An integral seating surface and seat back can be manufactured inexpensively, for example as a molded plastic part. It is likewise possible to manufacture the seating surface and the seat back from plywood, preferably from press-molded plywood. With such integral seats, the seat back can advantageously be displaced together with the seating surface in order to obtain, for both, a favorable position for juxtaposition of the chairs. A separately embodied seating surface can be rested, in its raised position, against the seat back and held thereby in the raised position without requiring additional components for that purpose.

The seating surface can be pivoted out of the receiving region of the support by the fact that the rotation axis is constituted by a hinge connection between the seating surface and the support; and that the hinge connection is arranged in a front region of the seating surface, in particular along a front edge of the seating surface, or in a rear region of the seating surface, in particular along a rear edge of the seating surface. Thanks to the arrangement of the rotation axis between the support and the seating surface, and along an edge of the seating surface, the latter is lifted, in its raised position, completely above the support. The receiving region or regions of the support arranged below the raised seating surface are thereby exposed.

In order to prevent the chairs from bumping against one another with their armrests when they are juxtaposed, provision can be made that two pivotable armrests are associated with the chair; and that the armrests also pivot upon displacement of the seating surface between the sitting position and the raised position. The armrests can thereby be brought into a position that permits two chairs to be closely juxtaposed.

Advantageously, provision can be made that the seating surface is held unassistedly in its raised position. No force therefore needs to be applied by the juxtaposed chair in order to hold in its raised position the seating surface of the chair against which it was juxtaposed. Pressure points, and increased wear, can thereby be avoided.

The unstressed seating surface can be held unassistedly in its raised position by the fact that at least one positioning element, in particular a gas spring, which exerts on the seating surface a force directed from the sitting position into the raised position, is arranged between the seating surface and the support. The positioning element simultaneously has a damping effect when the seating surface is displaced back into its sitting position.

According to a preferred variant configuration of the invention, provision can be made that a stop, against which the seating surface indirectly or directly abuts in the sitting position, is arranged on the support; that the stop constitutes a part of the outer receiving region and/or a part of the inner receiving region; and that the stop is embodied to interact with a stop receptacle of a juxtaposed chair. The stop performs two functions. On the one hand it serves for secure and load-bearing abutment of the seating surface in its sitting position. On the other hand, it engages into the receiving region of a juxtaposed chair and thus establishes the correct mutual positions of the chairs. It is thereby possible to prevent chair parts from undesirably bumping into each other and thereby damaging the chairs.

Provision can furthermore advantageously be made that a stop buffer is arranged on the seating surface; that with the seating surface in the sitting position, the stop buffer rests against the stop; and/or that with the seating surface in the raised position, the stop buffer is aligned in a juxtaposition direction with respect to a chair of identical design to be juxtaposed. Together with the stop, the stop buffer constitutes a secure and load-bearing abutment for the seating surface in its sitting position. The stop buffer can be produced from an elastic material, in particular from rubber. The stop buffer thus has an impact-damping effect as loads on the seating surface change. With the seating surface in the raised position, the stop buffer points in a direction from which a further chair can be juxtaposed. When a chair is juxtaposed, it can bump, for example with its seating surface or its seat back, against the stop buffer of the adjacent chair. The spacing between the chairs is thus adjusted so that they do not bump in undefined fashion against one another and thereby become damaged. If the stop buffer is produced from an elastic material, it absorbs the impact energy as the chairs are juxtaposed. Premature wear on the chairs can thereby be avoided. Additional contact between the stop buffer and the seating surface or seat back of juxtaposed chairs is advantageous in particular for shell chairs having no upholstery, since no pressure points on the upholstery are produced because of the stop buffer.

In order to allow chairs to be juxtaposed, the bases must not get in the way. This can be achieved by the fact that the base is connected rotatably to the support; and that a locking apparatus acts between the base and the support in such a way that, at least with the seating surface in the upright position, the base and the support are mutually aligned in a predetermined rotational position. In the predetermined rotational position, the support along with the seat, and the base, are mutually aligned in such a way that one chair can be placed against the receiving region of a second chair and at the same time the bases can be slid into one another. It is thereby possible to furnish a chair that has a seat rotatable around a vertical rotation axis and can be juxtaposed in space-saving fashion against other chairs of identical design.

The base and the seat of the chair can be aligned unassistedly with one another by the fact that the base is connected to the support rotatably around a second rotation axis and in a manner preloaded against gravity; and that upon unloading of the seating surface, a locking element coupled to the support engages into a centering cam of the base. As soon as the seating surface is unloaded, the support along with the seating surface aligns itself with respect to the base in such a way that the chair can be juxtaposed against a chair of identical design.

According to a preferred configuration of the invention, provision can be made that the base is constituted by a star base; that spokes of the base are fastened, respectively with a lateral offset from a radial line proceeding from a hub of the base, to the hub; and that the spokes are arranged in a circumferential direction with respect to the hub with respect to the respective radial line. Chairs having star bases embodied in this manner can, with a suitable alignment of the star bases, be slid into one another and thus juxtaposed. Locking can be effected as described above. In a locked position, the star bases are preferably oriented in such a way that one spoke of the star base faces forward with reference to the seat of the chair, one toward the rear, and two further ones toward respectively opposite sides of the chair. Thanks to the arrangement of the spokes on the hub, the rear spoke of a front chair and the front spoke of a rear juxtaposed chair are laterally offset. The chairs can thus be juxtaposed against one another, the mutually facing spokes of the bases sliding past one another. Advantageously, the spokes proceeding from the hub are oriented obliquely downward. The front or rear spoke of a chair can thus be respectively slid under a lateral spoke of a juxtaposed chair.

One possible variant of the invention is such that the support protrudes beyond the second rotation axis; and that the inner and the outer receiving region are arranged at least locally on the protruding support region. This makes possible not only linear guidance but also radial guidance of the juxtaposed chairs, preventing individual chairs from twisting.

Figure 1:
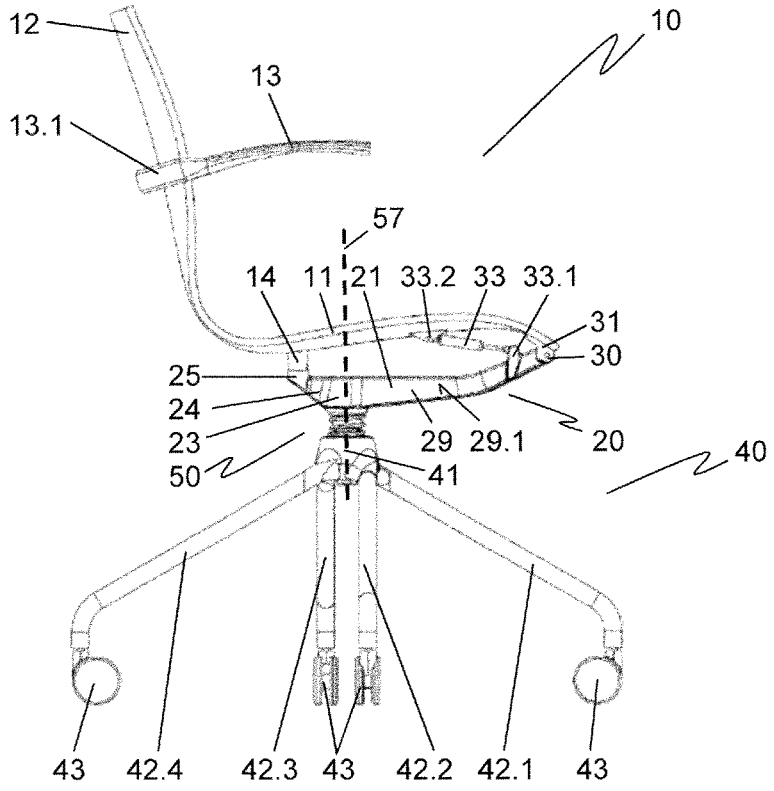
FIG. 1 is a side view of a chair in a sitting position.

FIG. 1 is a side view of a chair 10 in a sitting position. A seating surface 11 and a seat back 12 of chair 10 are embodied integrally. For this purpose, seating surface 11 and seat back 12 are connected to one another via a shaped-on curved portion. Armrests 13 are fastened to seat back 12 by means of a bracket 13.1. The seating surface 11 may also be referred to as a seat 11.

Figure 2:
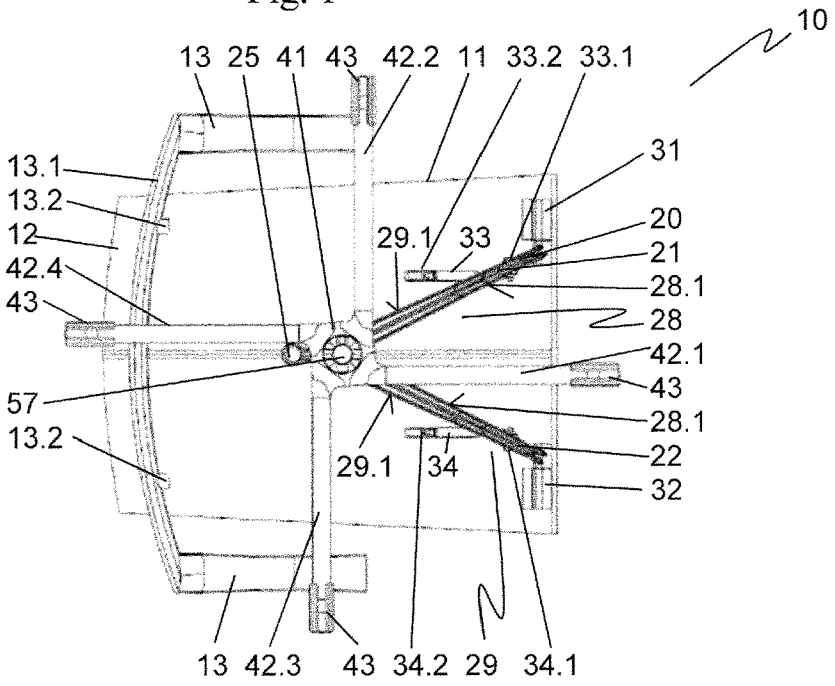
FIG. 2 is a view from below of the chair shown in FIG. 1.

Seating surface 11 is mounted on a support 20. Support 20 has a connecting portion 23 on which limbs 21, 22 shown in FIG. 2 are fastened. Limbs 21, 22 are preferably connected integrally to connecting portion 23. Located oppositely from limbs 21, 22, a stop 25 is fastened via an attachment strut 24 to connecting portion 23. Attachment strut 24 and stop 25 are also preferably connected integrally to connecting portion 23. A stop surface of stop 25 is oriented toward seating surface 11. A stop buffer 14 is fastened to seating surface 11 oppositely from stop 25. With seating surface 11 in the sitting position, stop buffer 14 rests on stop 25. That outer contour of support 20 which is directed to the side constitutes, at least locally, an outer receiving region 29 having outer abutment regions 29.1. Outer receiving region 29 is constituted at least in part by sub-portions of limbs 21, 22 and of stop 25. Connecting portion 23 and attachment strut 24 can also be embodied, by way of a corresponding conformation of support 20, as part of outer receiving region 29.

Seating surface 11 is connected to support 20 pivotably around a rotation axis 30. Rotation axis 30 is constituted by two hinge elements 31, 32 as shown in FIG. 2. Hinge elements 31, 32 are arranged under the front edge of seating surface 11 and at the front ends of limbs 21, 22 of support 20. Rotation axis 30 thus extends below the front edge of seating surface 11.

Two positioning elements 33, 34 in the form of gas springs are arranged, spaced apart from one another, between seating surface 11 and support 20, as shown in FIG. 2. Positioning elements 33, 34 are fastened pivotably to limbs 21, 22 of support 20 by means of support-side holding elements 33.1, 34.1. Positioning elements 33, 34 are furthermore articulatedly connected to the underside of seating surface 11 by means of seat-side holding elements 33.2, 34.2.

Support 20 is connected via a seat bearing system 50 to a base 40. Seat bearing system 50 allows support 20 to rotate around a vertically arranged second rotation axis 57.

Base 40 is embodied as a star base. It comprises a hub 41 on which spokes 42.1, 42.2, 42.3, 42.4 of base 40 are fastened. Spokes 42.1, 42.2, 42.3, 42.4, proceeding from hub 41, are oriented so as to proceed obliquely downward, and are bent downward at their ends. A chair caster 43, in the form of a double caster in the exemplifying embodiment that is shown, is arranged at the end of each spoke 42.1, 42.2, 42.3, 42.4. Chair casters 43 are connected to spokes 42.1, 42.2, 42.3, 42.4 pivotably around an axis.

Spokes 42.1, 42.2, 42.3, 42.4 are arranged with a respective lateral offset from a notional radial line proceeding from hub 41. In the exemplifying embodiment shown, spokes 42.1, 42.2, 42.3, 42.4 are fastened approximately tangentially to hub 41. Spokes 42.1, 42.2, 42.3, 42.4 are all arranged with an offset in a rotational direction with respect to the respective radial lines. In the exemplifying embodiment shown, as is evident in particular from FIG. 2, spokes 42.1, 42.2, 42.3, 42.4 are offset clockwise with respect to the radial lines when viewed from below.

An ergonomically shaped seat is created thanks to the integrally connected seating surface 11 and seat back 12. Seating surface 11 and seat back 12 are preferably, and at least in part, embodied as a molded plastic part. The molded plastic part can be at least locally covered with a cover, and upholstered. It is likewise possible for seating surface 11 and seat back 12 to be made of plywood, in particular of press-molded plywood. These too can be entirely or partly covered with a cover, and upholstered. According to a possible configuration of the invention which is not depicted, provision can furthermore be made that the armrests are integrally connected to seat back 12 and/or to seating surface 11. For example, a seat shell having a seat back 12 and seating surface 11, which also comprises an area embodied for resting the arms, can be constituted. The manufacturing costs for chair 10 can thereby be further decreased.

Seating surface 11 is articulatedly connected to support 20 via hinge elements 31, 32. In the sitting position shown in FIG. 1, seating surface 11 rests with its rear region, having the attached stop buffer 14, on stop 25 of support 20. This ensures stable and load-bearing support of seating surface 11 in the sitting position. Positioning elements 33, 34 exert a force on seating surface 11. The force is directed so that it moves seating surface 11 into a raised position shown in FIG. 3. The force of positioning elements 33, 34 can be adjusted so that it unassistedly pushes seating surface 11, together with the shaped-on seat back 12, into the raised position, or so that additional manual assistance is necessary for that purpose. In the latter case, the force is preferably adjusted so that positioning elements 33, 34 can hold seating surface 11 in the raised position.

Seating surface 11 can thus be moved around rotation axis 30 between a sitting position and a raised position, seat back 12 also being displaced. Armrests 13 fastened to seat back 12 are likewise pivoted. Seating surface 11 is held in the raised position by positioning elements 33, 34.

Seat bearing system 50 is embodied so that support 20, and thus seating surface 11 along with seat back 12, can rotate around rotation axis 57 with respect to base 40.

Thanks to chair casters 43 fastened to spokes 42.1, 42.2, 42.3, 42.4, chair 10 can be rolled and the location of chair 10 can thus be modified.

FIG. 2 shows chair 10 shown in FIG. 1, in a view from below. Seating surface 11 transitions integrally into seat back 12. Bracket 13.1 is fastened to seat back 12 by means of bracket holders 13.2. Bracket 13.1 carries armrests 13.

The illustration clearly shows the V-shaped orientation of the two limbs 21, 22 of support 20. In an alternative embodiment of the invention, limbs 21, 22 can also be oriented in U-shaped fashion. They can also each have a shape deviating from a straight-line shape, for example a curved shape. An inner receiving region 28 is constituted between limbs 21, 22. Those regions of limbs 21, 22 which face toward one another form inner abutment regions 28.1 of inner receiving region 28. Those regions of limbs 21, 22 which face away from one another constitute at least part of outer receiving region 29 having outer abutment surface 29.1. Inner and outer receiving regions 28, 29 are conformed correspondingly to one another. As shown below, this makes it possible for a second chair 10 to be juxtaposed against first chair 10, outer receiving region 29 of the one chair 10 being received by inner receiving region 28 of the other chair 10, and abutment regions 28.1, 29.1 abutting at least locally against one another.

Figure 3:
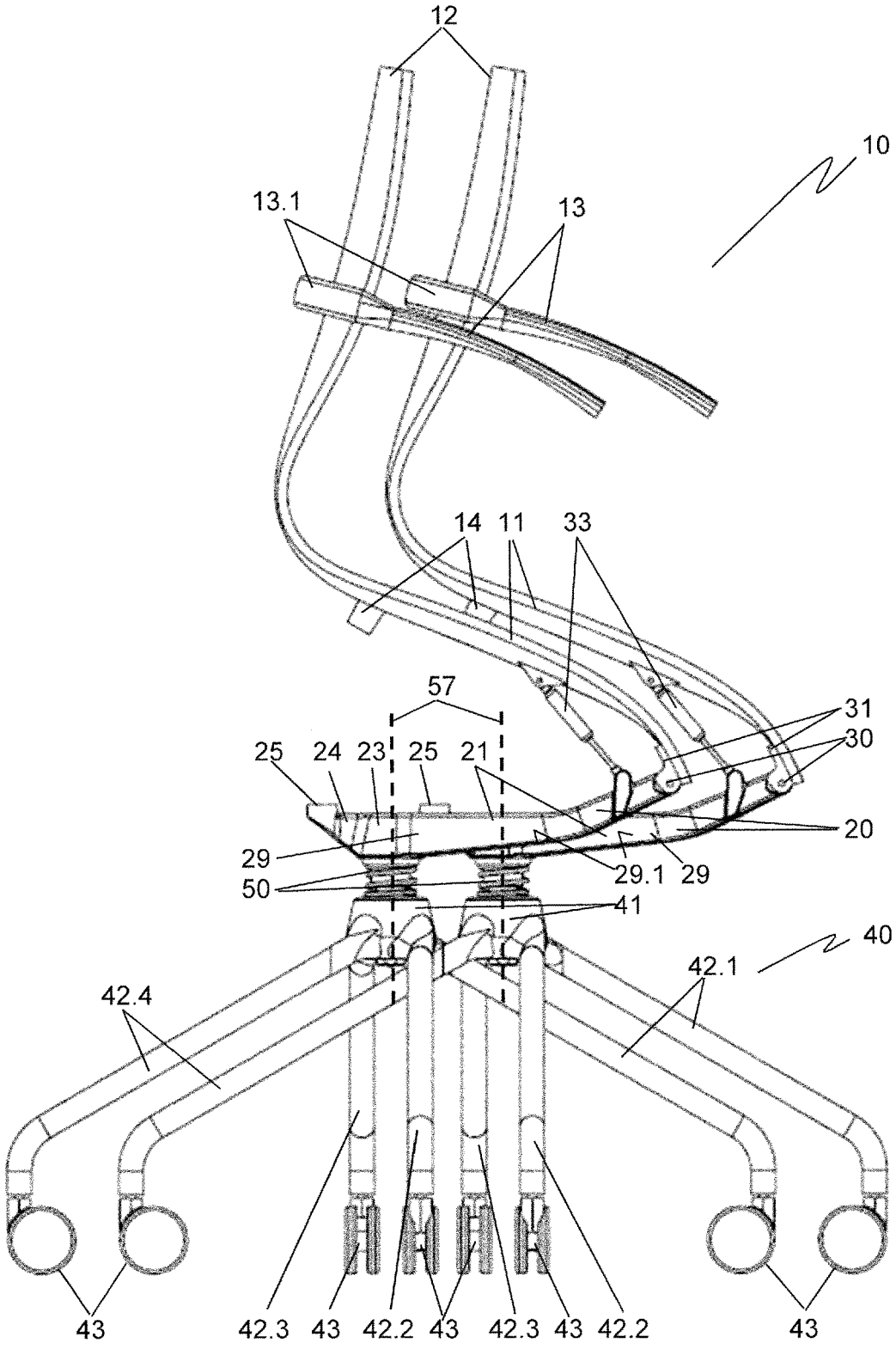
FIG. 3 is a side view of two juxtaposed chairs of identical design corresponding to FIG. 1.
Figure 4:
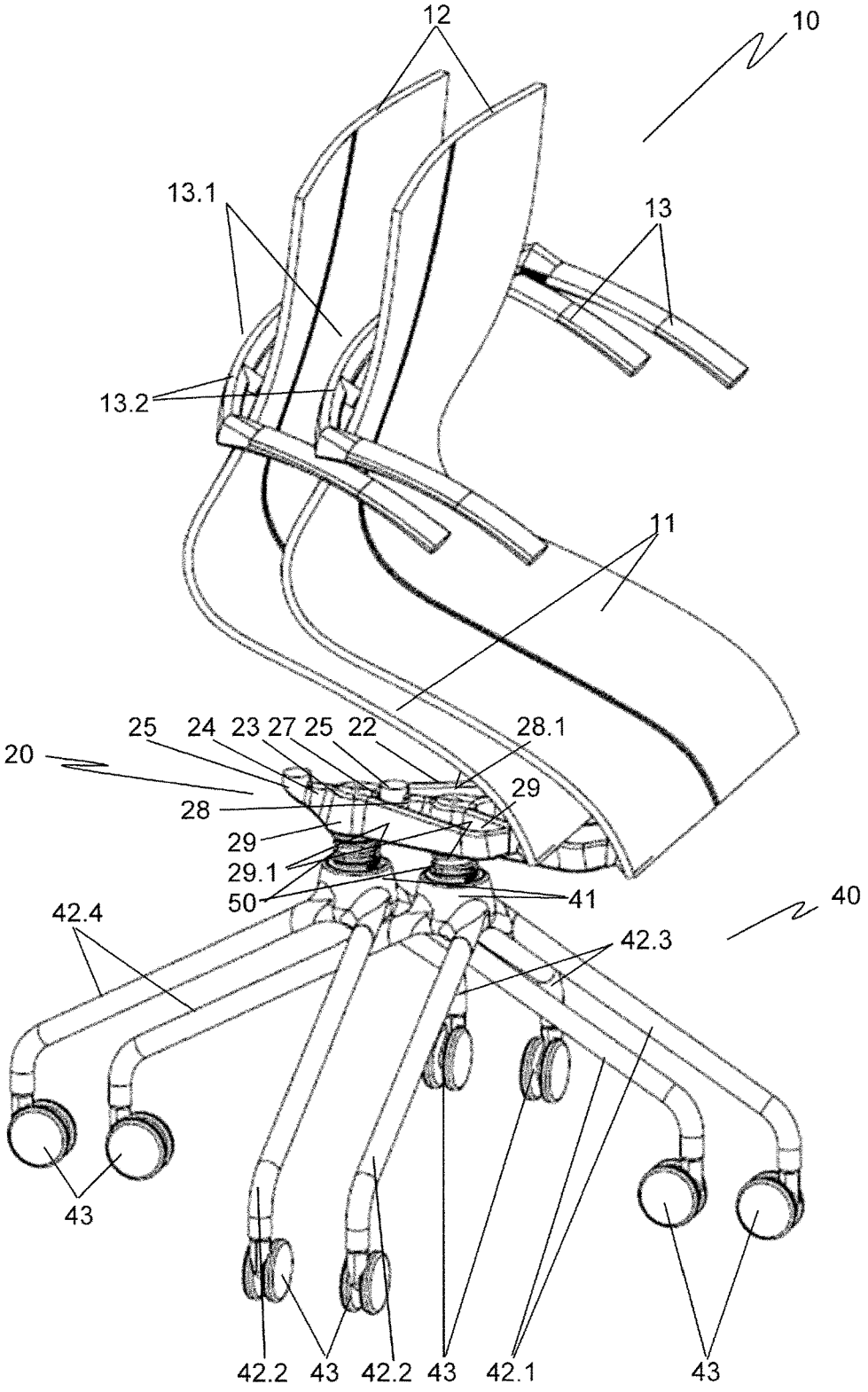
FIG. 4 is a perspective side view of the chairs shown in FIG. 3.

FIG. 3 is a side view of two juxtaposed chairs 10 of identical design, corresponding to FIG. 1. FIG. 4 is a perspective side view of the chairs shown in FIG. 3. As is evident from the two Figures, seats 11 are displaced for that purpose into their raised position. They are held in that position by positioning elements 33, 34. Seat backs 12 connected to seats 11 are likewise shifted in position, and thereby oriented to be tilted obliquely forward. Armrests 13 are thereby also displaced and arranged obliquely. The seats constituted by seating surfaces 11 and seat backs 12 can thus be slid into one another. As a result of their oblique alignment, seating surfaces 11 and armrests 13 open up space for juxtaposition respectively of a further seating surface 11 and of further armrests 13. In the exemplifying embodiment shown, stop buffer 14 of front chair 10 abuts against seating surface 11 of rear chair 10 when chairs 10 are juxtaposed. Said buffer thereby establishes, together with supports 20 bumping against one another, a desired spacing between chairs 10. This prevents chairs 10 from bumping against one another at regions not provided for the purpose, and becoming scratched or worn at those points. The stop buffer is preferably produced from an elastic material, in particular from rubber or as a composite rubber-metal component. In accordance with an alternative embodiment of the invention, provision can also be made that stop buffer 14 of front chair 10 does not touch the juxtaposed rear chair 10. Pressure points produced by stop buffer 14, for example on a seat cushion of the juxtaposed chair 10, can thereby be avoided.

As is evident in particular from FIG. 4, supports 20 of the juxtaposed chairs 10 engage into one another. Carrier 20 of the front chair 10 travels with its outer receiving region 29 into inner receiving region 28 of carrier 20 of the rear chair 10. For that purpose, the seat of the front chair 10 has exposed outer receiving region 29 of its support 20 as a result of its raised position. Support 20 is curved upward toward the front side of chair 10, so that rotation axis 30 of the rear chair 10 lies above the insertion plane of outer receiving region 29 of the front chair 10. Thanks to the arrangement of rotation axis 30 below the edge of seating surface 11, no portion of seating surface 11 is swung downward into the region of the insertion plane when seating surface 11 is raised. As a result, inner receiving region 29 remains exposed even when seating surface 11 is in the raised position. Because of these features, support 20 of the front chair 10 can be pushed through under the front edge of seat 11 the rear chair 10 and slid into inner receiving region 28 of the rear chair 10. Chair 10 according to the present invention thus makes it possible for chairs 10 of identical design to be juxtaposed against one another from both the front and the rear. In the rolling direction of chairs 10, chairs 10 juxtaposed against one another are not acted upon by any forces pushing them apart. A row of chairs thereby constituted therefore does not need to be secured to prevent chairs 10 from rolling apart.

Stop buffer 14 of the front chair 10 braces against seating surface 11 of the rear chair 10. This prevents the seats of the juxtaposed chairs from bumping or rubbing against one another and thereby being damaged.

Inner receiving region 28 constitutes a stop receptacle 27 at the meeting point of limbs 21, 22. When chairs 10 are juxtaposed, stop 25 of the front chair 10 engages into stop receptacle 27 of the rear chair 10. Stop receptacle 27 and stop 25 thus define how far a support 20 of a front chair 10 can be inserted with its outer receiving region 29 into inner receiving region 28 of a rear chair 10. Two juxtaposed chairs 10 thus abut against one another in defined fashion between stop 25 and stop receptacle 27 and, depending on the embodiment of stop buffer 14, between seating surface 11 and stop buffer 14. Laterally oriented portions 28.1, 29.1 of the inner and outer abutment regions can additionally abut against one another, preferably in the region of limbs 21, 22. Lateral guidance of the juxtaposed chairs 10 is thereby ensured.

With seating surface 11 in a raised position, base 40 is aligned with regard to support 20 and seating surface 11 arranged thereon. The alignment is effected in such a way that with reference to the orientation of seating surface 11, first spoke 42.1 is oriented forward and fourth spoke 42.4 is oriented rearward. Second and third arms 42.2, 42.3 project out laterally. For alignment of base 40 with respect to support 20 along with seating surface 11, there is provided on seat bearing system 50 a locking apparatus that establishes and defines the above-described alignment, as described in more detail with reference to FIGS. 5 and 6. Thanks to the lateral arrangement, described with reference to FIG. 2, of spokes 42.1, 42.2, 42.3, 42.4 on hub 41, the rearward-facing fourth arm 42.4 of the front chair 10 and the forward-facing first arm 42.1 of the rear chair 10 are offset laterally from one another. They can thus be slid past one another upon juxtaposition of chairs 10.

In summary, what is achieved by raising seat 11 into the raised position is as follows:

a. receiving regions 28, 29 of supports 20 become exposed;
b. seats 11 are held in the raised position;
c. armrests 13 become arranged obliquely; and
d. spokes 42.1, 42.2, 42.3, 42.4 that are arranged with a lateral offset become aligned with reference to support 20 and seating surface 11.

It thereby becomes possible to juxtapose any number of chairs 10 of identical design against one another in space-saving fashion, chairs 10 being in contact only at predetermined points, so that unintended wear does not occur on further mutually contacting chair components. Because seating surface 11 is held unassistedly in the raised position, no mechanical stress is transferred to a juxtaposed chair 10, thereby once again minimizing wear on, or the risk of damage to, a chair 10. Further chairs 10 can be juxtaposed onto a row of chairs from in front or from behind.

Figure 5:
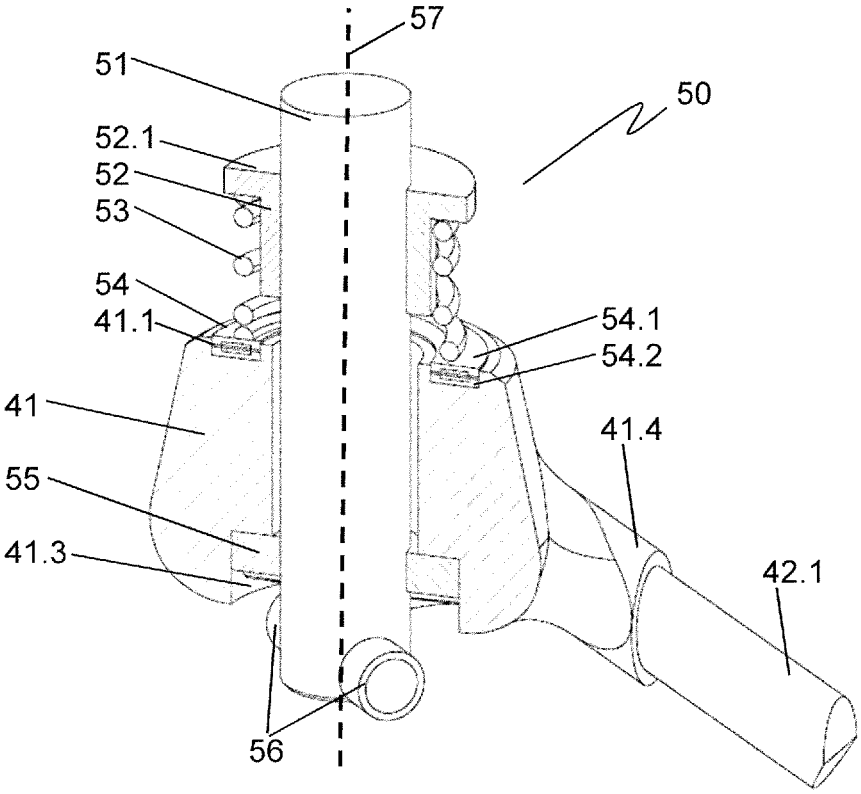
FIG. 5 is a perspective view, executed in part as a sectioned depiction, of a seat mounting system arranged between a support and a base.

FIG. 5 is a perspective view, partly executed as a sectioned depiction, of a seat bearing system 50 arranged between support 20 and base 40.

Hub 41, depicted in section, of base 40 has a post receptacle 41.2 in the form of a longitudinal bore. A bearing receptacle 41.1 is introduced at an end of hub 41 facing toward seating surface 11. Bearing receptacle 41.1 is embodied as a groove surrounding post receptacle 41.2. A shaft locating washer receptacle 41.3 is recessed into hub 41 oppositely from bearing receptacle 41.1. Spoke mounts 41.4, only one of which is visible in the selected depiction, are shaped laterally onto hub 41. Spokes 42.1, 42.2, 42.3, 42.4 are inserted into spoke mounts 41.4 and fastened therein. In the depiction selected, only first spoke 42.1 is shown. Spoke mounts 41.1 are shaped tangentially onto hub 41.

A post 51 is guided through post receptacle 41.2. On post 51, a sleeve 52 having a shaped-on flange 52.1 is slid onto post 51 toward seating surface 11, and connected thereto. At the opposite end, two locking elements 56 are fastened to post 51. Locking elements 56 are embodied as rotatably mounted rollers attached diametrically to post 51.

A thrust bearing 54 is placed into bearing receptacle 41.1 of hub 51. Thrust bearing 54 is embodied as a rolling bearing. It comprises a first and a second housing locating washer 54.1, 54.2, second housing locating washer 54.2 being held in bearing receptacle 41.1. A compression spring 53 rests against thrust bearing 54. Located oppositely, compression spring 54 abuts against flange 52.1 of sleeve 52. Flange 52.1 is connected (not depicted) to support 20.

Figure 6:
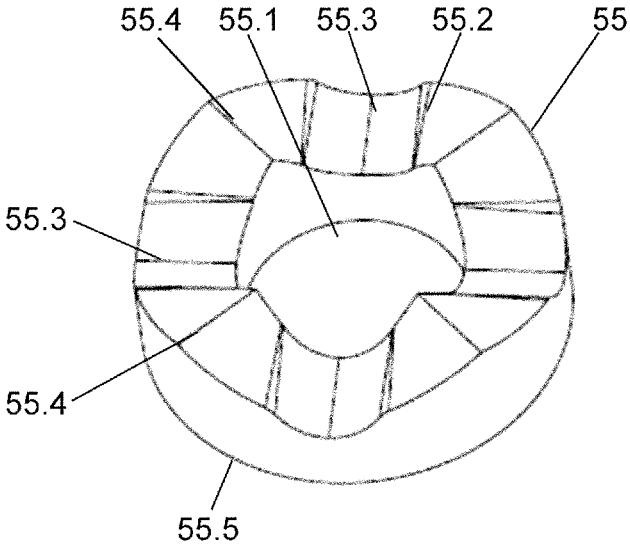
FIG. 6 is a perspective view of a shaft locating washer.

A shaft locating washer 55 is secured in shaft locating washer receptacle 41.3 of hub 41. FIG. 6 is a perspective view showing shaft locating washer 55 from below. Shaft locating washer 55 has a central bore 55.1 in which post 51 is guided, as shown in FIG. 5. Shaft locating washer 55 comprises, facing toward locking elements 56, a centering cam 55.2 having respectively four successive cam depressions 55.3 and four cam elevations 55.4. Oppositely from centering cam 55.2, shaft locating washer 55 is terminated by a radially oriented bracing surface 55.5. As shown in FIG. 5, shaft locating washer 55 abuts with bracing surface 55.5 against hub 41, while centering cam 55.2 is directed toward locking elements 56.

The functioning of seat bearing system 50 will be described with reference to FIG. 5, which depicts seat bearing system 50 as it exists with a seat under load. Post 51 is fastened on sleeve 52; flange 52.1 of sleeve 52 carries support 20 and thus seating surface 11. Compression spring 53 preloads sleeve 52 with respect to hub 41, and thus support 20 with respect to base 40. With seating surface 11 under load, for example because a person is sitting on it, post 51 is pushed downward against the spring force, and locking elements 56 are thereby brought out of engagement with centering cam 55.2 of shaft locating washer 55. Post 51, and thus the seat of chair 10, can now be rotated around second rotation axis 57. Support 20 along with seating surface 11 is supported on thrust bearing 54 via sleeve 52 and compression spring 53, thereby resulting in smooth rotational motion. Post 51 is guided radially in central bore 55.1 of shaft locating washer 55, thereby preventing tilting of post 51 and thus of seating surface 11. When seating surface 11 is not under load, compression spring 53 presses hub 41, and sleeve 52 having post 51 fastened thereto, apart. Locking elements 56 are thereby pushed against centering cam 55.2 of shaft locating washer 55, in which context locking elements 56, embodied as rotatably mounted rollers, roll from cam elevations 55.4 into cam depressions 55.3. The seat of chair 10, having seating surface 11 and seat back 12, is thereby oriented with respect to base 40. Shaft locating washer 55 that is shown produces four equivalent orientations. Shaft locating washer 55 is oriented with respect to hub 41 in such a way with no load on chair 10, the orientation of spokes 42.1, 42.2, 42.3, 42.4 is as described with reference to FIGS. 3 and 4.

In an alternative embodiment of the invention, provision can be made that centering cam 55.2 is shaped directly into hub 41, for example in the region of shaft locating washer receptacle 41.3 that is shown. Locking elements 56 then engage into that centering cam 55.2 in the manner described with reference to shaft locating washer 55. A shaft locating washer 55 constituting an additional component can thus be omitted. Hub 41 is then advantageously produced from a load-bearing material, in particular metal, particularly preferably as a die-cast component.

Figure 7:
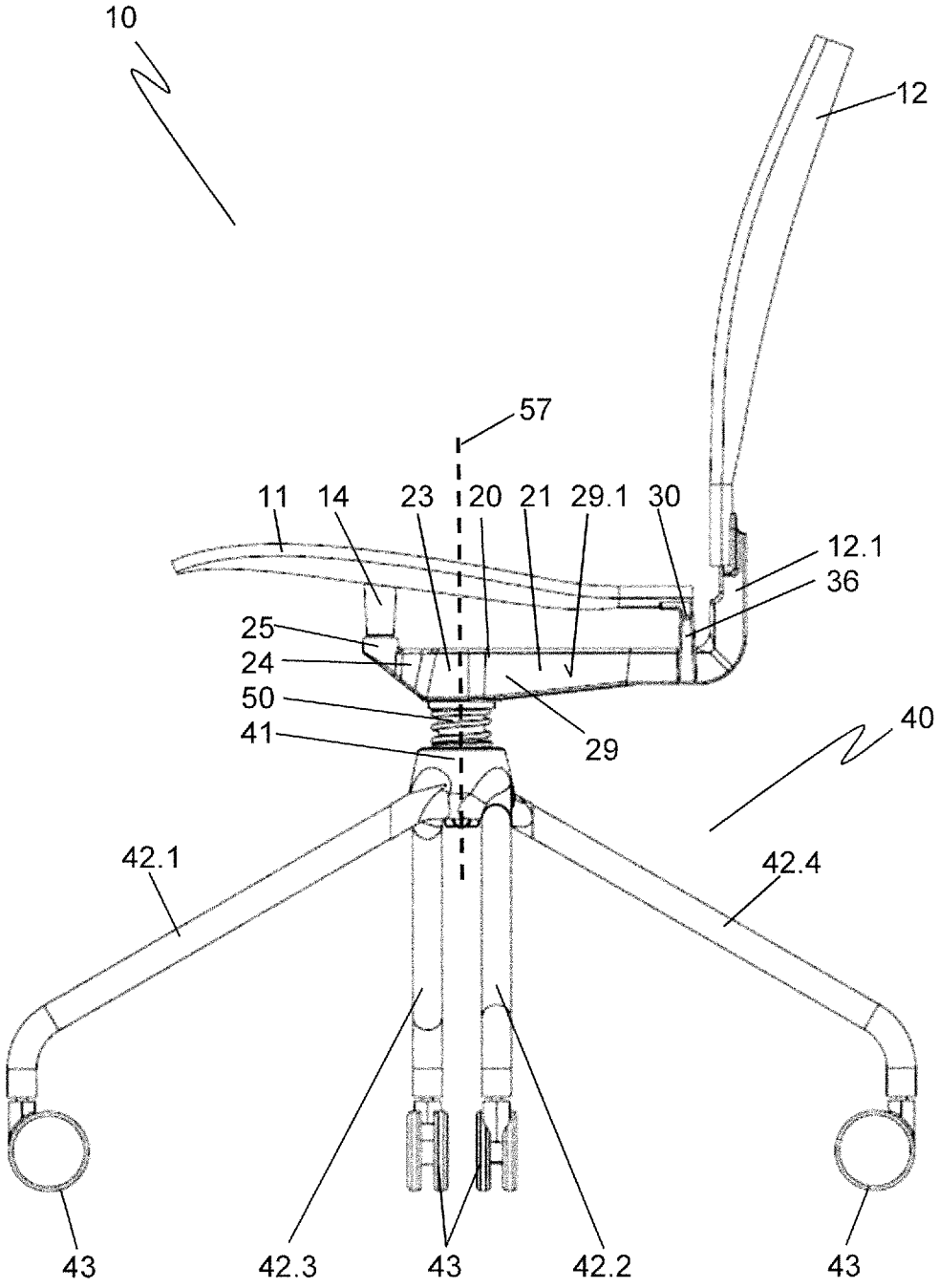
FIG. 7 is a side view of a chair having a seating surface and seat back embodied separately.
Figure 8:
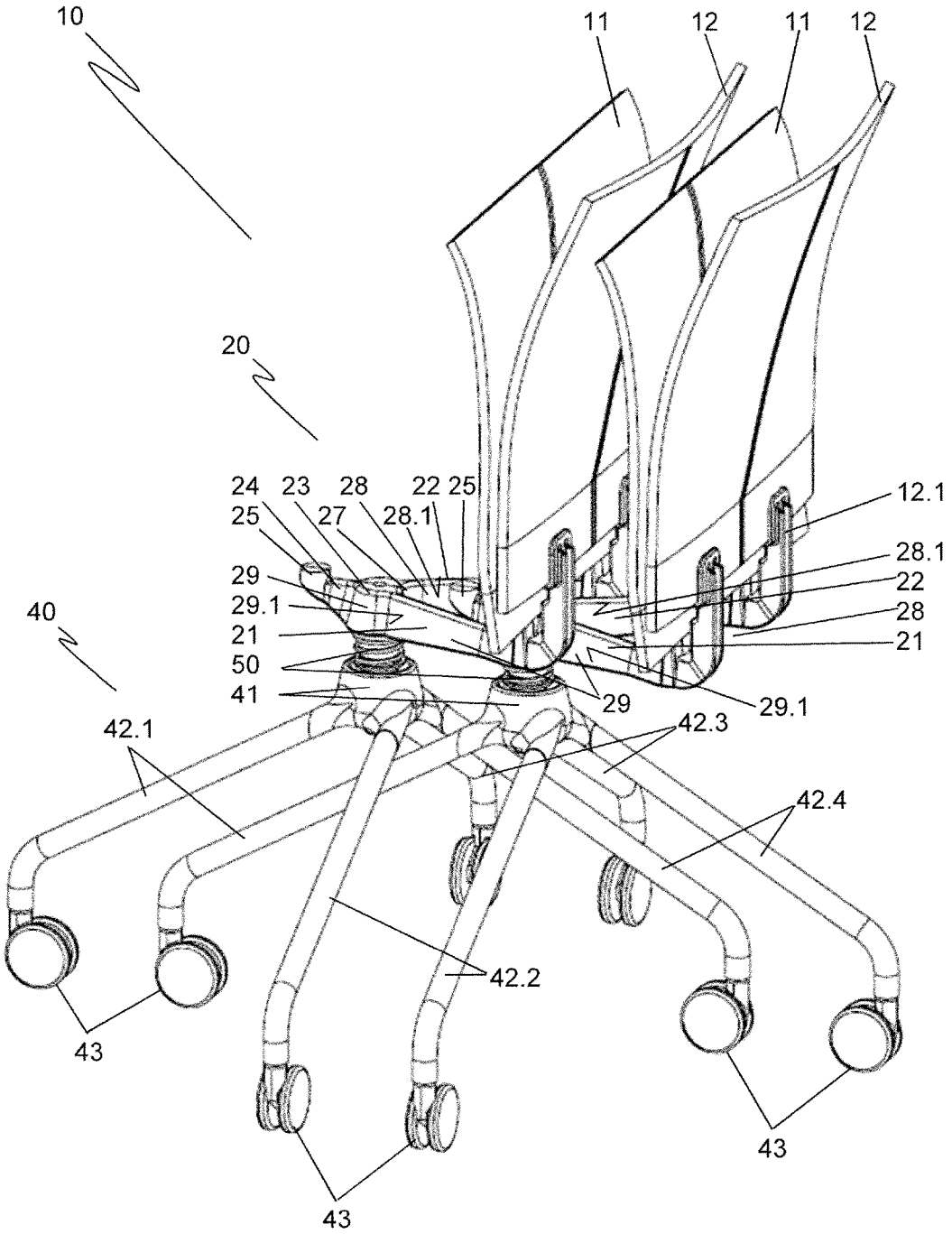
FIG. 8 is a perspective side view of two juxtaposed chairs of identical design corresponding to FIG. 7.

FIG. 7 is a side view of a chair 10 having a separately embodied seating surface 11 and seat back 12. FIG. 8 is an accompanying perspective side view showing two juxtaposed chairs 10 of identical design corresponding to FIG. 7.

Unlike with chair 10 shown in FIGS. 1 to 4, seating surface 11 and seat back 12 are embodied and held separately. Support 20 is, for this purpose, rotated 180° with respect to chair 10 shown in FIGS. 1 to 4, so that the opening of inner receiving region 28 now faces rearward toward seat back 12. Limbs 21, 22 of support 20 are prolonged out beyond seating surface 11, where they are curved upward. The curved regions form backrest holders 12.1 to which seat back 12 is fastened. Aside from these changes, support 20 is constructed identically to support 20 described in FIGS. 1 to 4.

Seating surface 11 is connected to support 20 by means of a third hinge element 36 and a fourth hinge element (not shown). The third 36 and fourth hinge element are aligned in such a way that rotation axis 30 extends below the rear edge of seating surface 11. Seating surface 11 can be swung upward around rotation axis 30. In its raised position, seating surface 11 abuts against seat back 12, the angle of seating surface 11 being selected so that the swung-up seating surface 11 remains in the raised position.

Stop buffer 14 is arranged in the center region of seating surface 11 and, with seating surface 11 in the sitting position, rests on stop 25. When seating surface 11 is swung up and chairs 10 are juxtaposed, stop buffer 14 of the rear chair 10 abuts against seat back 12 of the front chair 10. The correct spacing between chairs 10 is thereby established, thus preventing chairs 10 from undefinedly bumping into one another and thereby becoming damaged.

Base 40 and seat bearing system 50 are identical, in terms of their construction and function, to what is described and shown in FIGS. 1 to 6.

With chair 10 shown in FIGS. 7 and 8, outer receiving region 29 of support 20 is also exposed when seating surface 11 is swung up. Thanks to the positioning of rotation axis 30 along the edge of seating surface 11, inner receiving region 28 of chair 10 also remains exposed when seating surface 11 is raised, and is not covered by regions of the seating surface which swing downward. Chairs 10 can thus be juxtaposed in the manner described, outer receiving region 29 of support 20 of the rear chair 10 being slid into inner receiving region 28 of support 20 of the front chair 10. Stop 25 of support 20 of the rear chair 10 is slid into stop receptacle 27 of support 20 of the front chair 10, thereby effecting relative positioning of the juxtaposed chairs. Lateral guidance of chairs 10 is furthermore accomplished by way of lateral portions 28.1, 29.1 of inner and outer abutment regions, at which supports 20 abut against one another. A straight row of chairs 10 juxtaposed against one another is thereby obtained. Here as well, seating surfaces 11 advantageously are held unassistedly in the raised position, so that no forces are transferred to adjacent chairs 10 and thereby cause increased wear.

The invention claimed is:

1. A chair comprising:

a base;

a support connected to the base, the support including at least one receiving region configured for aligned abutment of a juxtaposed second chair of identical design;

a seat pivotable relative to the support about a rotation axis between a sitting position and a raised position of the seat, wherein in the raised position the seat is pivoted out of the at least one receiving region of the support and exposes the at least one receiving region of the support;

the at least one receiving region of the support including an inner receiving region open outward and an outer receiving region, and the raised position of the seat exposes the inner receiving region and the outer receiving region;

a stop configured as a part of one of the outer receiving region and the inner receiving region;

a stop receptacle configured as a part of the other of the outer receiving region and the inner receiving region; and wherein the stop is configured to interact with the stop receptacle of a juxtaposed second chair of identical design.

2. The chair of claim 1, wherein:

the support includes two limbs connected at one end to each other, the two limbs including inner limb regions facing toward one another and forming at least a portion of the inner receiving region of the support, and the two limbs including outer limb regions facing away from one another and forming at least a portion of the outer receiving region of the support.

3. The chair of claim 2, wherein:

the two limbs are arranged with respect to one another in a U-shape or V-shape.

4. The chair of claim 1, further comprising:

a seat back integrally connecting to the seat.

5. The chair of claim 1, further comprising:

a seat back embodied separately from the seat, the seat back being fastened indirectly or directly to the support.

6. The chair of claim 1, further comprising:

a hinge connection between the seat and the support, the hinge connection defining the rotation axis, the hinge connection being arranged along a front edge of the seat.

7. The chair of claim 1, further comprising:

a hinge connection between the seat and the support, the hinge connection defining the rotation axis, the hinge connection being arranged along a rear edge of the seat.

8. The chair of claim 1, further comprising:

two armrests supported from the seat so that the armrests pivot with the seat between the sitting position and the raised position.

9. The chair of claim 1, wherein:

the seat is held unassistedly in its raised position.

10. The chair of claim 1, further comprising:

at least one gas spring connected between the support and the seat, the at least one gas spring being configured to exert on the seat a force urging the seat from the sitting position into the raised position.

11. The chair of claim 1, further comprising:

a stop buffer arranged on the seat and configured such that with the seat in the sitting position the stop buffer rests against the stop, the stop buffer being configured such that with the seat in the raised position the stop buffer is arranged to engage a juxtaposed second chair of identical design.

12. The chair of claim 1, wherein:

the support is rotatable relative to the base about a second rotation axis; and the base includes a hub and a plurality of spokes fastened to the hub, each spoke being laterally offset from a radial line proceeding from the second rotation axis.

13. The chair of claim 1, wherein:

the support is rotatable relative to the base about a second rotation axis; and the support further includes a protruding support region protruding beyond the second rotation axis, and the inner receiving region and the outer receiving region are arranged at least partially on the protruding support region.

14. A chair comprising:

a base;

a support connected to the base, the support including at least one receiving region configured for aligned abutment of a juxtaposed second chair of identical design; and a seat pivotable relative to the support about a rotation axis between a sitting position and a raised position of the seat, wherein in the raised position the seat is pivoted out of the at least one receiving region of the support and exposes the at least one receiving region of the support;

wherein the support is rotatable relative to the base about a second rotation axis; and wherein the chair further includes a lock arranged between the base and the support, the lock being configured such that with the seat in the raised position the base and the support are automatically aligned in a predetermined rotational position relative to each other.

15. The chair of claim 14, wherein:

the lock includes a centering cam attached to the base, a locking element attached to the support, and a spring biasing the support away from the base against gravity, the lock being configured such that upon unloading of the seat the spring biases the locking element against the centering cam.

* * * * *